United States Patent [19]

Lawson et al.

[11] 4,238,749

[45] Dec. 9, 1980

[54] HIGH INRUSH CURRENT CIRCUIT BREAKER

[75] Inventors: Martin W. Lawson, North Easton; David M. Brown, North Attleboro, both of Mass.

[73] Assignee: Texas Instruments Incorporated, Attleboro, Mass.

[21] Appl. No.: 974,420

[22] Filed: Dec. 29, 1978

[51] Int. Cl.[3] ..... H01H 7/02; H01F 3/12

[52] U.S. Cl. ..... 335/63; 335/236

[58] Field of Search ..... 335/59, 62, 63, 236, 335/239, 240

[56] References Cited

U.S. PATENT DOCUMENTS

| | | | |
|---|---|---|---|
| 3,307,130 | 2/1967 | Camp | 335/236 |
| 3,689,855 | 9/1972 | Setone et al. | 335/236 |
| 3,777,294 | 12/1973 | Grenier | 335/236 |

*Primary Examiner*—Harold Broome

*Attorney, Agent, or Firm*—John A. Haug; James P. McAndrews; Melvin Sharp

[57] ABSTRACT

An electromagnetic circuit breaker is provided having a flux producing solenoid and a movable armature attractable to the solenoid upon the occurrence of a predetermined current level and duration. A flux path in the form of members of low reluctance are arranged so that the flux circuit comprises a plurality of loops, each loop having one or more variable reluctances which are dependent upon the position of the armature and a movable core located within the solenoid. Increased pulse resistance is obtained without substantially effecting the operation of the switch upon sustained overloads of a predetermined level and duration. The bobbin on which the solenoid coil is wound is provided with a groove with which a member of low reluctance is lockingly engaged. Other low reluctance members are configured to facilitate assembly of the circuit breaker.

6 Claims, 6 Drawing Figures

HIGH INRUSH CURRENT CIRCUIT BREAKER

This invention relates generally to electromagnetic switches, and more particularly to a time delay circuit breaker which will allow predetermined transients to pass through the breaker without causing the breaker to trip.

A switch of this type having a solenoid and movable time delay core movably disposed therein is the subject matter of U.S. Pat. No. 3,740,650 which issued June 19, 1973. In that patent the switch is provided with an auxiliary backframe against which the clapper of the armature tripping mechanism rests when the circuit breaker is in the "on" position thereby providing an alternate path for the generated magnetic flux. With the time delay core down, this path has a smaller total air gap than does the normal tripping flux circuit in the main frame and therefore has a lower total reluctance. When an inrush occurs the magnetic flux generated by the solenoid takes the path of least reluctance which is through the auxiliary frame to complete the flux circuit. Accordingly the circuit breaker is able to withstand a high inrush without tripping. However, during sustained overload conditions the core of the solenoid picks up to switch the path of least magnetic reluctance from the auxiliary backframe to the main frame thereby pulling the clapper down and tripping the circuit breaker.

While the above described circuit breaker is effective for many applications a need still existed to pass even larger transients or pulses without affecting the circuit breaking function on normal sustained overloads. This need led to the development of a circuit breaker described and claimed in U.S. Pat. No. 3,777,294 which issued Dec. 4, 1973. In that patent a switch is disclosed which comprises magnetic members including main, auxiliary and shunt frames, arranged so that a flux circuit is formed with three loops each including one or more variable reluctances. The reluctances are switched between high and low values by the movement of the armature and a movable core within the flux producing solenoid. A magnetic bias is applied to the armature by flux passing through one loop during pulses which are to be passed through the switch while some of the flux caused by the pulses is diverted into another loop; however, upon a sustained overload essentially all the flux passes through the third loop which includes the so called working gap of the magnetic switch, that is the gap between the clapper and the pole piece of the solenoid. This is accomplished by opening one loop with the core pick up and opening and shunting another loop with the closing of the clapper.

The circuit breaker described in the latter mentioned patent is still highly effective in allowing large transients or pulses to pass through the breaker without substantially affecting the circuit breaking function on normal sustained overloads, however, in several aspects it has been difficult, time consuming and hence costly to assembly the circuit breaker as disclosed in that patent. In particular, assembly of the auxiliary backframe and shunt frame to the solenoid and time delay mechanism has been cumbersome. A specific spatial relationship between these parts is required to assure proper functioning of the apparatus and in order to maintain this relationship it was found that it was necessary to solder the auxiliary frame to the dashpot of the time delay mechanism. Further, due to the specific orientation of the opening in the shunt plate and the closeness of the several components of the circuit breaker to one another, it was difficult for an assembler to manipulate the solenoid assembly into its proper position.

Thus among the several objects of the invention may be noted the provision of an electromagnetic circuit breaker having auxiliary flux path frames to render the breaker insensitive to high current transients of a short duration in which assembly of the device is facilitated without sacrifice of efficiency or reliability of operation of the breaker. Another object is the provision of a circuit breaker of the type described and claimed in U.S. Pat. No. 3,777,294 referred to supra having an improved structural relationship between the flux path members, particularly the auxiliary and shunt frames, and the solenoid assembly including the time delay mechanism.

The invention accordingly comprises the elements and combination of elements, steps and sequence of steps, features of construction and manipulation, and arrangement of parts, all of which will be exemplified in the structures hereinafter described, and the scope of the application of which will be indicated in the appended claims.

In the accompanying drawings in which the preferred embodiment of the invention is illustrated:

FIG. 1 is an elevational view, partly in cross section and partly schematic of a circuit breaker essentially as shown in U.S. Pat. No. 3,777,294;

Figure 1:
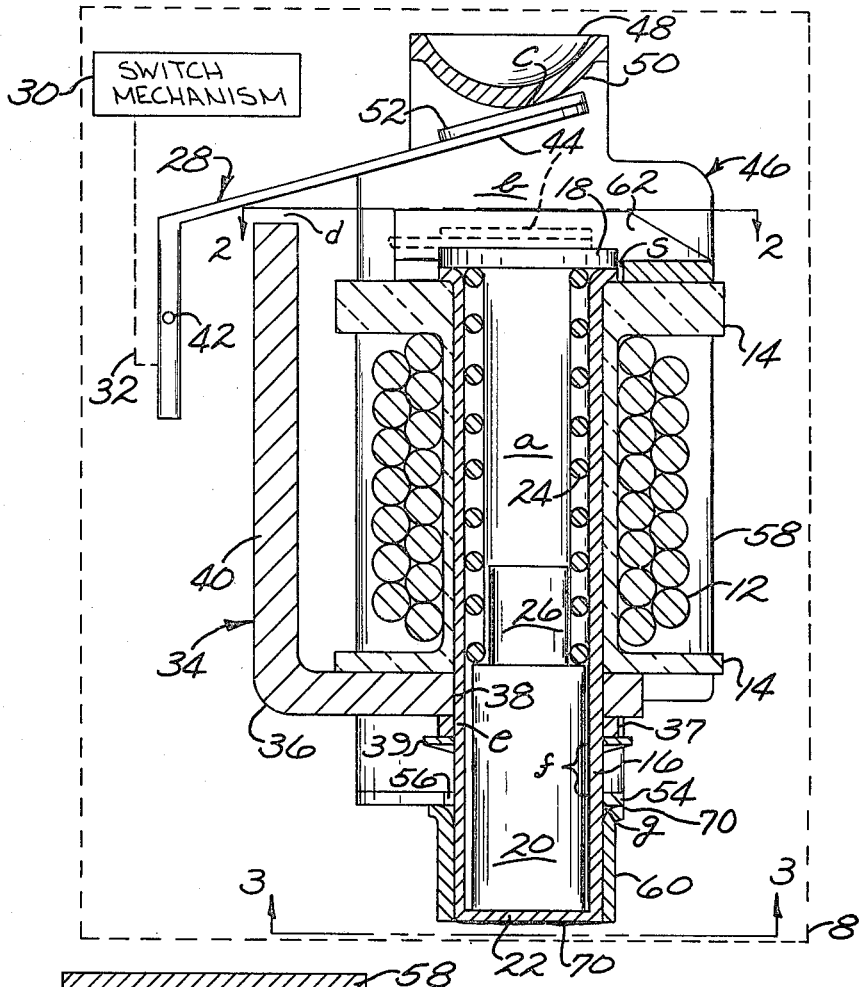
Fig. 1. PRIOR ART

Dimensions of certain of the parts as shown in the drawings may have been modified or exaggerated for the purpose of clarity of illustration.

Briefly, in accordance with the invention, the circuit breaker solenoid includes a bobbin of non magnetic material upon which the solenoid coil is wound and which is provided with an additional flange at an end thereof adjacent the pole piece thereby forming an annular groove into which a portion of a shunt frame is received. The shunt frame has a free distal end portion with two fingers forming a generally U-shaped configuration which fit into the groove around the bobbin to lockingly maintain the solenoid and time delay mechanism mounted within the solenoid in a fixed position relative to the auxiliary frame to which the shunt frame is affixed. The auxiliary frame has two legs spaced from and encompassing opposite ends of the solenoid with one such leg provided with a free distal end portion having two fingers forming a generally U-shaped configuration which extend in a direction generally parallel to the two fingers of the shunt frame and receive therebetween the dashpot of the time delay mechanism. The device is assembled by placing the solenoid assembly onto the main frame with the dashpot received in a bore formed on a portion thereof and is retained there by a tinnerman type fastener which is pushed onto the dashpot against the main frame portion. The auxiliary frame is placed in a mating recess in a housing member, the assembly comprising the main frame, solenoid and switch mechanism is merely slipped into place in the housing with the bobbin groove received in the slot formed between the fingers of the shunt frame and the dashpot received in the slot formed between the fingers in the leg of the auxiliary frame.

Figure 2:
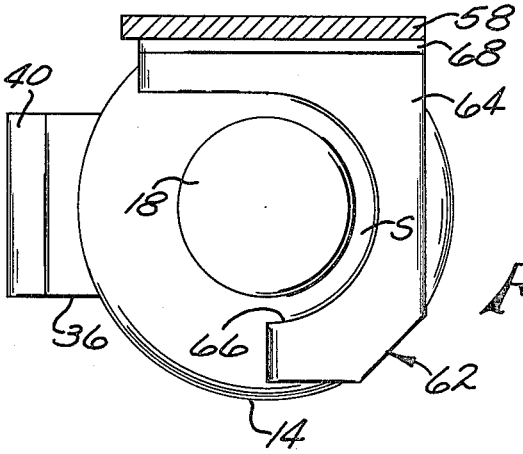
Fig. 2. PRIOR ART
FIG. 2 is a cross sectional view taken on lines 2—2 of FIG. 1.
Figure 3:
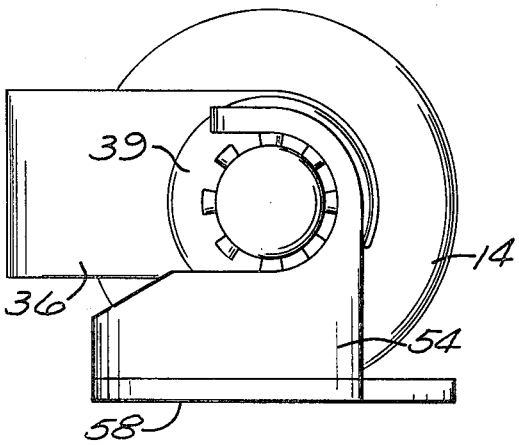
Fig. 3. PRIOR ART
FIG. 3 is a view taken on lines 3—3 of FIG. 1, but with solder collar 60 removed.

Referring now to the drawings, in particular to FIGS. 1–3, numeral 10 refers to a circuit breaker which has found acceptance in the market place and essentially as disclosed in U.S. Pat. No. 3,777,294. Flux producing means comprises a solenoid 12 wound on a non magnetic bobbin 14. A dashpot mechanism comprising a thin-walled elongated tube 16 of brass or other suitable non magnetic material, closed at its upper end by a cover or cap 18 secured to the tube, is telescopically received within solenoid 12. Cover 18 is magnetizable and constitutes a pole piece of the circuit breaker. The lower end of tube 16 is closed as indicated at 22. An elongated armature core 20 is disposed in tube 16 and is shorter than the tube and movable axially therein. Core 20 is made of iron, steel, or other suitable magnetizable material.

A hydraulic fluid or other suitable fluid is inserted in and substantially fills the portion of tube 16 not occupied by core 20. The fluid is forced from one end of the tube to the other around the periphery of the core when core 20 is moved in the tube. Passage around the periphery constitutes a restriction which limits the rate of flow from one end of tube 16 to the other end thereof, thereby retarding the rate of movement of core 20 and providing a desired time delay for sustained overloads.

The bottom end 22 of tube 16 projects from the solenoid and the core is biased against closed end 22 (the position shown in the drawings) by a return coil spring 24 which reacts from the inner surface of cover 18 against the upper end of core 20.

Passage of current through solenoid 12 creats a magnetic field in and around the solenoid within the tube 16 which attracts core 20 toward the upper portion of tube 16 and into a central portion of the solenoid. When the core 20 reaches a central portion of the solenoid, the reluctance of the magnetic field is reduced due to the presence of the magnetizable core and there is a resulting increase in the strength of the magnetic field initially created by passing current through the solenoid. This increase in the magnetic field attracts armature 28 and is used to operate a switch mechanism 30 through linkage 32.

The solenoid assembly is mounted in a first generally L-shaped frame 34 formed by magnetizable material having a bottom solenoid supporting arm 36 provided with a tube receiving aperture 38 in the distal portion thereof so that the bottom of the solenoid is contiguous with arm 36, and an upstanding arm 40. A ring 37 of magnetizable material is disposed around tube 16 and held against arm 36 by means of a timmerman type fastener 39. Ring 37 enhances the magnetic coupling between core 20 and arm 36. Armature 28 adjacent arm 40 is pivotably mounted at 42 and has a distal free portion or clapper 44 adapted to move toward and away from pole piece 18. Armature 28 is normally biased into the position shown in solid lines in the non actuated condition either through the linkage mechanism 32 or a separate spring, for instance a spring located at pivot 42.

A second frame 46 of magnetizable material is generally U-shaped and encompasses frame 34, armature 28 and solenoid 12. Frame 46 has a first leg 48 located on the side of the armature portion 44 removed from the solenoid and is provided with a dimple 50. Shim 52 is also provided on the face of clapper 44 which comes into engagement with dimple 50. A second leg 54 is spaced from the bottom of the solenoid and interposed supporting arm 36. Leg 54 is provided with a slot 56 which receives the bottom portion of tube 16. Legs 48 and 54 of the second frame are connected by bight leg 58. Attached to leg 58 is a magnetic frame 62 formed of a suitable magnetic material such as steel. As seen in FIG. 2 frame 62 has a plate 64 formed with a slot 66 to form a radial gap between plate 64 and pole piece 18. Frame 62 is suitably attached to leg 58 as by welding upstanding plate 68 thereto. In order to minimize the reluctance between leg 54 and core 20 a sleeve 60 of magnetic material is placed about tube 16 in contact with leg 54. Sleeve 60 also serves as a solder collar and is soldered at 70 both to leg 54 as well as to the bottom portion of tube 16 to thereby fix the position of the time delay mechanism, and concomittantly the solenoid, with respect to the second frame 46.

Certain gaps are designed into the structure to effect the desired operation of the breaker. Neglecting leakage reluctances and any reluctance associated with the iron of the circuit the designed reluctance path is as follows. When the core is in the unactuated or down position shown in FIG. 1 gap a exists between core 20 and pole piece 18. A working gap b is that space between pole piece 18 and clapper 44 while gap c is between clapper 44 and dimple 50 including shim 52. Gap d is between armature 28 and arm 40 of frame 34, while the gap between arm 36 of frame 34 along with ring 37 and core 20 is identified by e. The gap between arm 36 of frame 34, along with ring 37, and the bottom leg 54 of frame 46 is represented by f. Gap g is located between core 20 and the combination of leg 54 and sleeve 60. Finally the radial gap between plate 64 and pole piece 18 is identified by s. The above structure forms in effect three loops, 2, 4 and 6. Loop 2 comprises flux generator 12 (ampere-turns), variable reluctance a, fixed reluctance s, variable reluctance g, and variable reluctance f. Loop 4 comprises the flux generator 12, variable reluctance a, variable reluctance b, variable reluctance d and fixed reluctance e. Loop 6 comprises fixed reluctance s and variable reluctances c and b. Thus reluctance s is common to loops 2 and 6.

When either no electric current or insufficient electric current passes through solenoid 12 to move core 20 upwardly, spring 24 maintains the core at the bottom of tube 16 even if the device is in a different orientation than that shown in FIG. 1 (e.g. askew or upside down). The device is calibrated so that the core will not move upwardly until a predetermined overload occurs (magnitude and duration of the overload being inversely proportional). As explained above, when the core moves to a central position in the solenoid, the electromagnetic force on armature 28 tending to attract it to the pole piece becomes strong enough to cause the armature to pivot to the dashed line position. This in turn causes the circuit breaker switch mechanism 30 to trip or break the circuit through linkage 32. A complete explanation of how the variable reluctances vary in response to the position of armature 28 and core 20 may be found in U.S. Pat. No. 3,777,294, supra.

Once the clapper 44 starts its downward motion in normal operation as the result of an overload the auxiliary magnetic circuit comprising loops 2 and 4, used to obtain resistance to short, high level pulses, are negated as much as possible so that adequate flux levels are provided in working gap c to produce maximum clapper forces necessary for reliable performances of the circuit breaking function. Device 10 accomplishes this optimum performance by opening loop 2 with pick up of core 20, by opening loop 6 with the closing of clapper 44 (clapper 44 contacting pole piece 18), and by shunting loop 6 with the closing of the clapper.

While the above described structure does provide a circuit breaker having excellent pulse resistance while at the same time maintaining essentially all of the flux through the working gap during a sustained overload to enhance its circuit breaking function it is difficult and time consuming to assemble. In view of the fact that the position of shunt plate 64 and pole piece 18 relative to one another have to be fixed, that is, gap s has to be maintained, it was required to solder collar 60 to leg 54 of auxiliary frame 46 as well as to tube 16 and due to the distance from this point of attachment to the critical area of gap s it was difficult to perform this operation quickly and with high yield. Prior to the soldering operation the solenoid and time delay assemblies were placed on the main frame with tube 16 received through bore 38 of arm 36, ring 37 and fastener 39 attached and the auxiliary frame slipped in place. Then collar 60 was attached and the soldering completed. Finally the assembly was placed in a recess in a circuit breaker housing 8.

Figure 4:
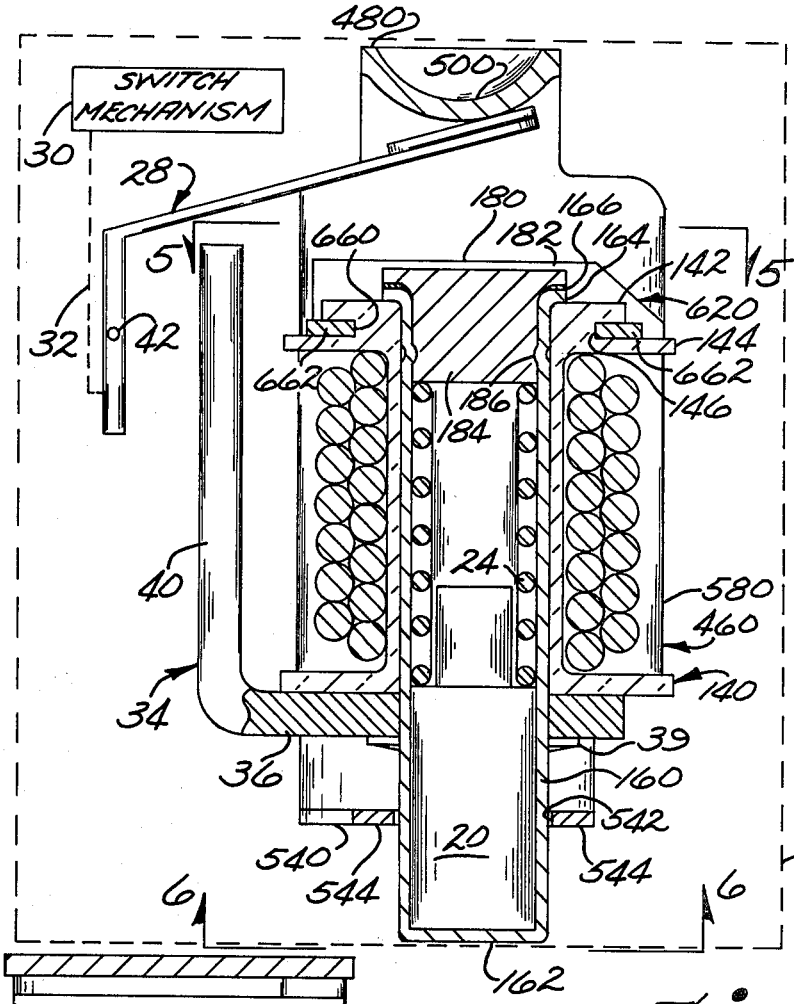
FIG. 4 is an elevational view similar to FIG. 1 of the preferred embodiment of the present invention.
Figure 5:
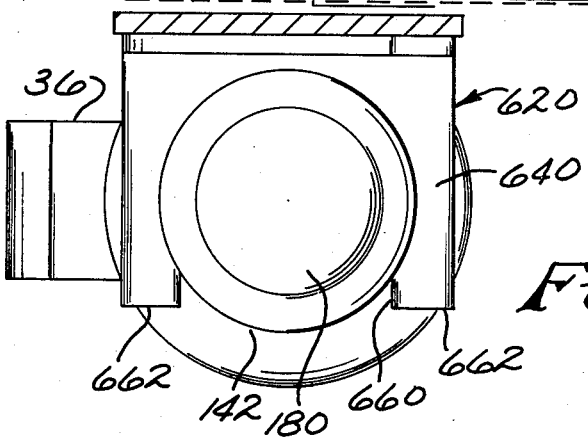
FIG. 5 is a cross sectional view taken on lines 5—5 of FIG. 4.
Figure 6:
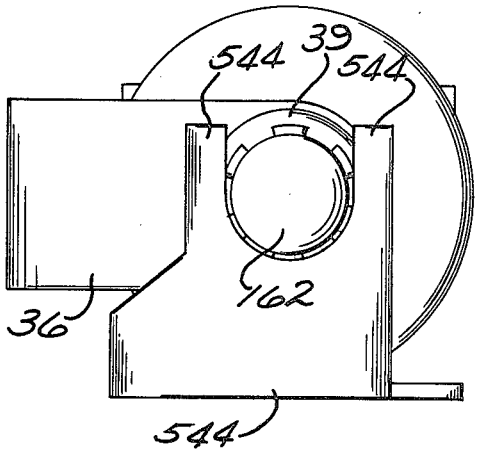
FIG. 6 is a view taken on lines 6—6 of FIG. 4.

In the structure of FIGS. 4–6 the orientation of the slot s in the shunt plate and the bottom leg of the auxiliary frame have been rotated 90° so that the auxiliary and shunt frame can be placed into the receiving recess in the circuit breaker housing 80 and the main frame on which the solenoid and time delay assembly has been mounted, is merely dropped into the housing with the shunt plate engaging a groove in the solenoid bobbin.

Main frame 34 is the same as shown in FIGS. 1–3 with arm 36 contiguous to the bottom end of solenoid 12 and arm 40 adjacent armature 28. Armature 28, linkage 32 and switch mechanism 30 are also the same as shown in FIGS. 1–3. Bobbin 140, of non magnetic material has been modified by adding a top, radially extending flange 142 adjacent the uppermost coil retaining flange 144. A groove 146 is formed between flanges 142, 144. Tube 160, of non magnetic material, has a closed end 162 and an open end formed with a radially extending flange 164 projecting therefrom. A matching radially extending flange 182 of pole piece 180 of magnetic material is soldered to flange 164 via a solder layer 166 therebetween. Pole piece 180 is formed with a centrally disposed hub 184 formed with a groove 186 around its periphery to facilitate attachment to tube 160 which is rolled into groove 186. The bottom surface of flange 164 is disposed on the top surface of bobbin flange 142 with the bottom of tube 160 projecting below the bobbin as in the FIG. 1–3 structure. Tube 160 also contains core 20, spring 24 and the time delay liquid as in the FIG. 1–3 structure.

Auxiliary frame 460 of magnetizable material is U-shaped and encompasses frame 34, armature 28 and solenoid 12 as in FIGS. 1–3. Frame 460 comprises first and second legs 540 and 480. Second leg 480 is located on the side of the armature portion removed from the solenoid and proximate thereto and is provided with a dimple 500. First leg 540 is proximate to but spaced from the bottom of the solenoid and interposed supporting arm 36 and is connected to leg 480 by bight leg 580. Leg 540 is provided with a slot 542 opening in a direction perpendicular to the plane in which the armature moves. The slot is defined by a pair of fingers 544 which are formed in a generally U-shaped configuration and spaced from one another to closely fit about tube 160. Attached as by welding to leg 580 is a magnetic frame 620 formed of a suitable magnetic material, such as steel. As seen in FIG. 5 frame 620 has a plate 640 formed with a slot 660 also opening in a direction perpendicular to the plane in which the armature moves. Slot 660 is defined by a pair of fingers 662 which are formed in a generally U-shaped configuration and spaced from one another to closely fit in groove 146 of bobbin 140. Fingers 662 of shunt plate 640 and 544 of leg 540 extend in parallel directions and perpendicular to the plane in which the armature moves. A radial gap is formed between plate 640 and pole piece 180, as in the FIG. 1–3 structure, however, in this case fingers 662 are lockingly engaged with the solenoid assembly to fix the position of the solenoid relative to the auxiliary and shunt frame. Groove 146 is located along the axis of tube 160 so that shunt plate 640 is intermediate the top surface of pole piece 180 and the bottom surface of hub 184 with gap s primarily between both flange 182 and hub 184 through bobbin 140.

It will be noted that ring 37 and sleeve 60 are not found in the FIG. 4–6 structure since it has been found that the desired pulse resistance is obtained without them when the shunt frame is mounted as disclosed.

Thus, the device is conveniently assembled by placing auxiliary and shunt frame 460, 620 into a receiving recess in the circuit breaker housing 80; the solenoid and time delay are assemblies are attached to the main frame which is in turn merely dropped in the housing so that fingers 662 are received in groove 146.

As various changes could be made in the above construction without departing from the scope of the invention, it is intended that all matter contained in the above description or shown in the accompanying drawings shall be interpreted as illustrative and not in a limiting sense.

In view of the above, it will be seen that the several objects of the invention are achieved and other advantageous results attained.

We claim:

1. An electromagnetic switch comprising a flux producing solenoid assembly having first and second ends and having a bobbin with a groove around its periphery, a pole piece disposed at the first end of the solenoid, an armature having a clapper portion movable toward and away from the pole piece, a tubular housing of non magnetic material received within the solenoid, a core of magnetic material movably mounted within the tubular housing, means forming a flux path including a main frame of magnetic material having a first path thereof contiguous to the second end of the solenoid, the main frame having a second part thereof adjacent a portion of the armature, an auxiliary frame of magnetic material having a first leg proximate the second end of the solenoid and spaced from the main frame, the first leg of the auxiliary frame having a pair of fingers formed in a generally U-shaped configuration, the tubular housing having an end which projects from the solenoid and received between the fingers of the first leg, the auxiliary frame having a second leg proximate the first end of the solenoid and spaced from the pole piece, the clapper movable between the pole piece and the second leg of the auxiliary frame, a member of magnetic material extending from the auxiliary frame disposed adjacent the pole piece and spaced therefrom, the member formed with a pair of fingers formed in a generally U-shaped configuration, the fingers disposed within the groove of the bobbin to lockingly engage with the solenoid assembly to fix the solenoid assembly relative to the auxiliary frame, and electrical contact means operatively associated with the armature, the pair of fingers of the member of magnetic material and the pair of fingers of the first leg of the auxiliary frame extending in parallel directions to facilitate assembly by dropping the main frame with the solenoid mounted thereon into position with the fingers of the member of magnetic material extending into the groove of the bobbin and the tubular housing disposed between the fingers of the first leg of the auxiliary frame.

2. An electromagnetic switch comprising, a flux producing solenoid assembly having first and second ends and a longitudinal axis, a pole piece disposed at the first end of the solenoid, an armature having a clapper portion movable toward and away from the pole piece, a tubular housing of non magnetic material received within the solenoid, a core of magnetic material movably mounted within the tubular housing, means forming a flux path including a main frame of magnetic material having a first part thereof contiguous to the second end of the solenoid, the main frame having a second part thereof adjacent a portion of the armature, an auxiliary frame of magnetic material having a first leg proximate the second end of the solenoid and spaced from the main frame, the auxiliary frame having a second leg proximate the first end of the solenoid and spaced from the pole piece, the clapper movable between the pole piece and the second leg of the auxiliary frame, a member of magnetic material extending from the auxiliary frame disposed adjacent the pole piece and spaced therefrom, the pole piece extending substantially beyond the magnetic material member along the longitudinal axis in both directions of the axis, the member lockingly engaged with the solenoid assembly to fix the solenoid assembly relative to the auxiliary frame, and electrical contact means operatively associated with the armature.

3. An electromagnetic switch comprising a flux producing solenoid assembly having first and second ends including a tubular shaped bobbin of non magnetic material having a pair of radially extending coil retaining flanges, an additional radially extending flange formed adjacent one of the pair of flanges forming a groove therebetween, a coil wound on the bobbin between the pair of flanges, a tubular housing of non magnetic material having first and second ends and having a length greater than that of the solenoid telescopically received within the bobbin, a core of magnetic material movably mounted within the tubular housing, the first end of the housing closed with a pole piece of magnetic material, the pole piece disposed adjacent a surface of the additional bobbin flange at the first end of the solenoid, an armature having a clapper portion movable toward and away from the pole piece, means forming a flux path including a main frame of magnetic material having a first portion contiguous to the second end of the solenoid, the main frame having a second portion adjacent a portion of the armature, an auxiliary frame of magnetic material having a first leg contiguous the second end tubular housing, the auxiliary frame having a second leg proximate the first end of the solenoid, the clapper movable between the pole piece and the second leg of the auxiliary frame, a shunt member of magnetic material extending from the auxiliary frame into the bobbin groove and electrical contact means operatively associated with the armature.

4. An electromagnetic switch according to claim 3 in which the first end of the tubular housing is formed with an outwardly extending radial flange, one side of the housing flange is attached to the pole piece while another side of the housing flange is received on a surface of the additional bobbin flange.

5. An electromagnetic switch comprising a flux producing solenoid assembly having first and second ends including a tubular shaped bobbin of non magnetic material having a pair of radially extending coil retaining flanges, an additional radially extending flange formed adjacent one of the pair of flanges forming a groove therebetween, a coil wound on the bobbin between the pair of flanges, a tubular housing of non magnetic material having first and second ends and a longitudinal axis and having a length greater than that of the solenoid telescopically received within the bobbin, a core of magnetic material movably mounted within the tubular housing, the first end of the housing closed with a pole piece of magnetic material, the pole piece disposed adjacent a surface of the additional bobbin flange at the first end of the solenoid, the pole piece extending substantially beyond the shunt member along the longitudinal axis in both directions of the axis, an armature having a clapper portion movable toward and away from the pole piece, means forming a flux path including a main frame of magnetic material having a first portion contiguous to the second end of the solenoid, the main frame having a second portion adjacent a portion of the armature, an auxiliary frame of magnetic material having a first leg contiguous the second end of the tubular housing the auxiliary frame having a second leg proximate the first end of the solenoid, the clapper movable between the pole piece and the second leg of the auxiliary frame, a shunt member of magnetic material extending from the auxiliary frame into the bobbin groove and electrical contact means operatively associated with the armature.

6. An electromagnetic switch comprising a flux producing solenoid assembly having first and second ends including a tubular shaped bobbin of non magnetic material having a pair of radially extending coil retaining flanges, an additional radially extending flange formed adjacent one of the pair of flanges forming a groove therebetween, a coil wound on the bobbin between the pair of flanges, a tubular housing of non magnetic material having first and second ends and having a length greater than that of the solenoid telescopically received within the bobbin, a core magnetic material movably mounted within the tubular housing, the first end of the housing closed with a pole piece of magnetic material, the pole piece disposed adjacent a surface of the additional bobbin flange at the first end of the solenoid, an armature having a clapper portion movable toward and away from the pole piece, means forming a flux path including a main frame of magnetic material having a first portion contiguous to the second end of the solenoid, the main frame having a second portion adjacent a portion of the armature, an auxiliary frame of magnetic material having a first leg contiguous the second end of the tubular housing, the auxiliary frame having a second leg proximate the first end of the solenoid, the clapper movable between the pole piece and the second leg of the auxiliary frame, a shunt member of magnetic material extending from the auxiliary frame into the bobbin groove, the shunt member and the first leg of the auxiliary frame having a pair of fingers formed in a generally U-shaped configuration and extending in parallel directions and electrical contact means operatively associated with the armature.

* * * * *